US006755614B1

(12) United States Patent
Lehman

(10) Patent No.: US 6,755,614 B1
(45) Date of Patent: Jun. 29, 2004

(54) MOLTEN METAL PUMP IMPELLER

(76) Inventor: Dale T. Lehman, 5577 Valley La., Solon, OH (US) 44139

( * ) Notice: Subject to any disclaimer, the term of this patent is extended or adjusted under 35 U.S.C. 154(b) by 0 days.

(21) Appl. No.: 10/272,221

(22) Filed: Oct. 16, 2002

Related U.S. Application Data

(62) Division of application No. 09/865,772, filed on May 25, 2001, now Pat. No. 6,468,039.
(60) Provisional application No. 60/207,554, filed on May 27, 2000.

(51) Int. Cl.[7] ..... F04D 7/06
(52) U.S. Cl. ..... 415/200; 416/185; 416/241 B
(58) Field of Search ..... 415/200, 206; 416/185, 241 B, 181, 182, 179, 233 B

(56) References Cited

U.S. PATENT DOCUMENTS 3,048,384 A 8/1962 Sweeney et al.
5,160,693 A 11/1992 Eckert et al. ..... 266/235
5,470,201 A * 11/1995 Gilbert et al. ..... 415/200
5,540,550 A 7/1996 Kubota ..... 416/179
5,634,770 A 6/1997 Gilbert et al. ..... 415/216.1
6,019,576 A 2/2000 Thut ..... 415/200
6,254,340 B1 7/2001 Vild et al. ..... 415/200

* cited by examiner

*Primary Examiner*—Edward K. Look
*Assistant Examiner*—J M. McAleenan
(74) *Attorney, Agent, or Firm*—Pearne & Gordon LLP

(57) ABSTRACT

An impeller for a molten metal pump includes a base and a plurality of vanes having openings for flow of molten metal there through during pumping. Alternatively, or in combination with the vane openings, a single drain opening extending through the base of the impeller may be provided remote of the rotational axis of the impeller. In another embodiment, an impeller provides axial and radial pumping. The multiflow impeller includes at least one pumping chamber inclined into the direction of rotation to provide axial pumping.

25 Claims, 10 Drawing Sheets

20
30
18
32
32
17
28
16
10
22
24
26
26
52
53
12
34
35
38
14
42

MOLTEN METAL PUMP IMPELLER

This application is a division of application Ser. No. 09/865,772, filed May 25, 2001, now U.S. Pat. No. 6,468,039 which application claims priority of U.S. Provisional Application No. 60/207,554, filed May 27, 2000.

BACKGROUND OF THE INVENTION AND RELATED ART

The present invention relates to pumps, and more particularly to pump apparatus and methods for pumping molten metal.

The use of pumps to pump molten metal such as aluminum or zinc is known in the art. Generally, molten metal pumps comprise centrifugal pumps modified to provide processing of the molten metal. To that end, circulation pumps are used to equalize temperature and improve homogeneity of mixture in a molten metal bath, transfer pumps are used to convey or transfer molten metal between locations and gas-injection pumps are used to circulate and inject gas into a molten metal to modify its composition as by removing dissolved gases or dissolved contaminant metals therefrom.

The pumps typically include a base or casing having a pumping chamber and an impeller received within the chamber. The base includes inlet and outlet passages for intake and discharge of the molten metal being pumped. The pump may be a volute pump wherein the pumping chamber has a volute shape comprising a spiral configuration of circumferentially increasing cross sectional area approaching the pump outlet passage. It is also possible to provide the pump with a pumping chamber having a generally circular shape.

The pump base together with the impeller are submerged in the molten metal and connected via a plurality of support posts to a drive arrangement positioned above the level of the molten metal. The impeller is supported for rotation within the pumping chamber by a rotatable shaft coupled to the drive arrangement. In typical installations, the drive shaft may be of various lengths, e.g. one to four feet in length or longer, in order to provide adequate clearance above the molten metal level.

A typical impeller includes at least two axially extending vanes and a radially extending member which forms a base when located below the vanes. In this manner the impeller provides a vane array with adjacent vanes cooperating with the base to form vane pockets. During pumping, molten metal is axially introduced into the pockets and laterally ejected due to centrifugal force.

The necessary spacing between the driver and impeller results in the use of an elongate drive shaft fixed to the impeller. This requires a relatively high degree of balance during operation and adequate bearing support between the impeller/shaft assembly and the housing. Operating vibration may damage the pump and/or limit its pumping efficiency.

The impeller may be fractured or otherwise damaged due to the vibrations and failure to maintain operating clearances. In molten metal pumping systems, bearings may be considered to operate on films of molten metal and poor concentricity yields reduced clearances which may cause the films to break down or not form so as to give rise to refractory material wear of increased rate.

SUMMARY OF INVENTION

The pumps and methods are characterized by unique fluid flow properties tending to smooth the rotation of the impeller by better equalizing the pressure between each pair of vanes within the vane array. This tends to reduce pump damage and bearing wear by suppressing repeated vibrational impacts during pump operation, e.g., chatter, while providing improved pump performance.

These improvements are achieved in part by the provision of circumferential feed flows of molten metal to the interior regions of the impeller during pumping. The circumferential flows are provided through openings extending through the vanes. The circumferential flows tend to enhance the completeness and uniformity of the filling and evacuation of the vane pocket between each pair of vanes by accelerating a flow of metal into a lower region of the pocket.

The advantages of circumferential feeds to the vane pockets or interior regions of the vane array of the impeller appear to relate to the rapid input of metal to the vanes pockets following the pumping radial ejection of metal therefrom. As the impeller begins its uniform circulatory motion, the continuity of the filling and emptying of the vane pockets with molten metal is enhanced by the circumferential flows through the vanes in accordance with the invention. The quicker one can get the media or molten metal to occupy that empty space the quipker the media will pump.

The fluid flow properties are further enhanced by the improved balancing or equalization of pressure within the vane pockets which are believed to reduce vibrations and fluid flow irregularities during pumping. In turn, the smoothness of impeller rotation tends to be enhanced by the increased continuity of the pumping action.

The openings extend from the opposed surfaces of the vane. The openings may be disposed at any location extending through the circumferential or peripheral thickness of the vanes and may have any desired axial or radial orientation. Thus, the openings may be inclined upwardly or downwardly relative to the direction of impeller rotation or in an orientation generally parallel with the impeller base.

The fluid or molten metal flow through the opening in the vane of the impeller is enhanced by disposing the opening at an inclined angle. That is, the opening is inclined upwardly into the direction of rotation of the vane so that an intake vector force is imposed on the fluid to bias flow into the opening and the interior region of the impeller. The angular orientation of the opening imposes an intake vector force on the molten metal that operates to expedite metal flow into and through the opening.

At least one opening may be provided in at least one vane. More preferably, a single opening may be provided in each vane or in less than all vanes provided a majority of the vanes include at least one opening. Accordingly, the impeller may include an imperforate vane.

Multiple openings may be provided in one or more of the vanes. Thus, an impeller may include imperforate, single opening and multiple opening vane or vanes. The rotational balance of the impeller and/or suppression of chatter characterized by repeated or regular vibrations may be reduced by trial and error depending upon the interaction of the impeller configuration, radial member or pump base and bearing mounting system.

The opening may have any convenient cross-sectional shape. For example, a circular cross-section is convenient, but oval or other shapes may be used. Further, the shape and/or size of the cross-sectional opening may vary along the axial length of the opening. For example, an opening may be provided with an enlarged inlet to enhance fluid intake.

In a further aspect of the invention, at least one drain hole provides safe drainage of molten metal from the impeller during removal of the pump from the molten metal for service or the like. The drain hole may extend through the radial member or base of the pump and be located in one of the vane pockets.

The single drain hole also tends to prevent thermal shock as the pump, or more particularly the impeller, is submerged into the molten metal. Following service of the pump apparatus, the impeller is relatively cool. As the impeller is submerged into the molten metal, the lower extremities of the impeller or impeller base are rapidly heated. Such rapid heating from a single side of the impeller raises the possibility of thermal shock and fracture of the refractory cement mounting the bearing ring to the impeller base. Accordingly, the rapid flow of the molten metal through the drain hole to upper impeller locations or top surface of the base tends to uniformly heat spaced regions on the impeller so as to suppress the possibility of thermal shock and fracture of the refractory cement.

Impeller drainage may be further improved by connecting the vane pocket in which the drain hole is located to other vane pockets by openings extending through the vanes. In such an arrangement, the advantages of circumferential flow and pressure equalization of the vane pockets are also achieved.

The selective angular placement of the drain opening or hole also serves to better balance the impeller. For example, the impeller may be characterized by material, configuration or dimensional variations which detract from true or balanced rotation without vibration. These variations may be offset by placement of the drain opening adjacent a location of increased angular momentum or higher rotational weight or the like that tends to detract from smooth rotation.

In accordance with yet another aspect of the invention, one or more additional hub drain holes may be provided. Such hub drain holes comprise openings extending through the impeller hub or other structure located just above the impeller radial member or base and communicating with the impeller drive shaft opening. As indicated, such hub drain holes are positioned just above the impeller radial member or base in order to enhance complete drainage of the vane pockets.

In accordance with a further aspect, of the invention, an improved impeller includes a body having a longitudinal axis and a plurality of elongate pumping chambers located adjacent the peripheral extremities of the body. The impeller body includes an end surface and a peripheral surface. The pumping chambers comprise elongate cavities or bores that intersect the end surface of the body to form cooperating impeller inlet openings and the peripheral surface of the body to form cooperating impeller outlet openings.

The pumping chambers have a length and a transverse width. The length to width ratio is 3:1 or greater, and more preferably, is in the range of from about 3:1 to about 20:1, and more preferably, from about 3:1 to about 5:1.

In illustrated embodiments, the impeller body has a cylindrical shape and each pumping chamber has a length that extends in a linear direction along the peripheral or cylindrical surface of the body. The pumping chambers extend along 10 to 100% of the longitudinal dimension of the body, or more preferably from 20% to 85%.

The pumping chamber may be disposed at an angle with respect to the longitudinal axis of the body ranging from 0° to 45°. The pumping chambers are inclined into the direction of impeller rotation and provide multiple flow pumping forces. More particularly, the inclined pumping chambers provide axial pumping by applying an axial force vector to the fluid as well as radial pumping by applying centrifugal force to the fluid in the chamber. Such multiflow pumping yields increased pressure and flow as compared with similarly sized impellers not having axial pumping.

As indicated, the pumping chambers are located adjacent the radial extremities of the body. Preferably, the pumping chambers are located in the outermost ⅓ of the transverse or radial dimension of the body.

DETAILED DESCRIPTION OF THE INVENTION

Figure 1:
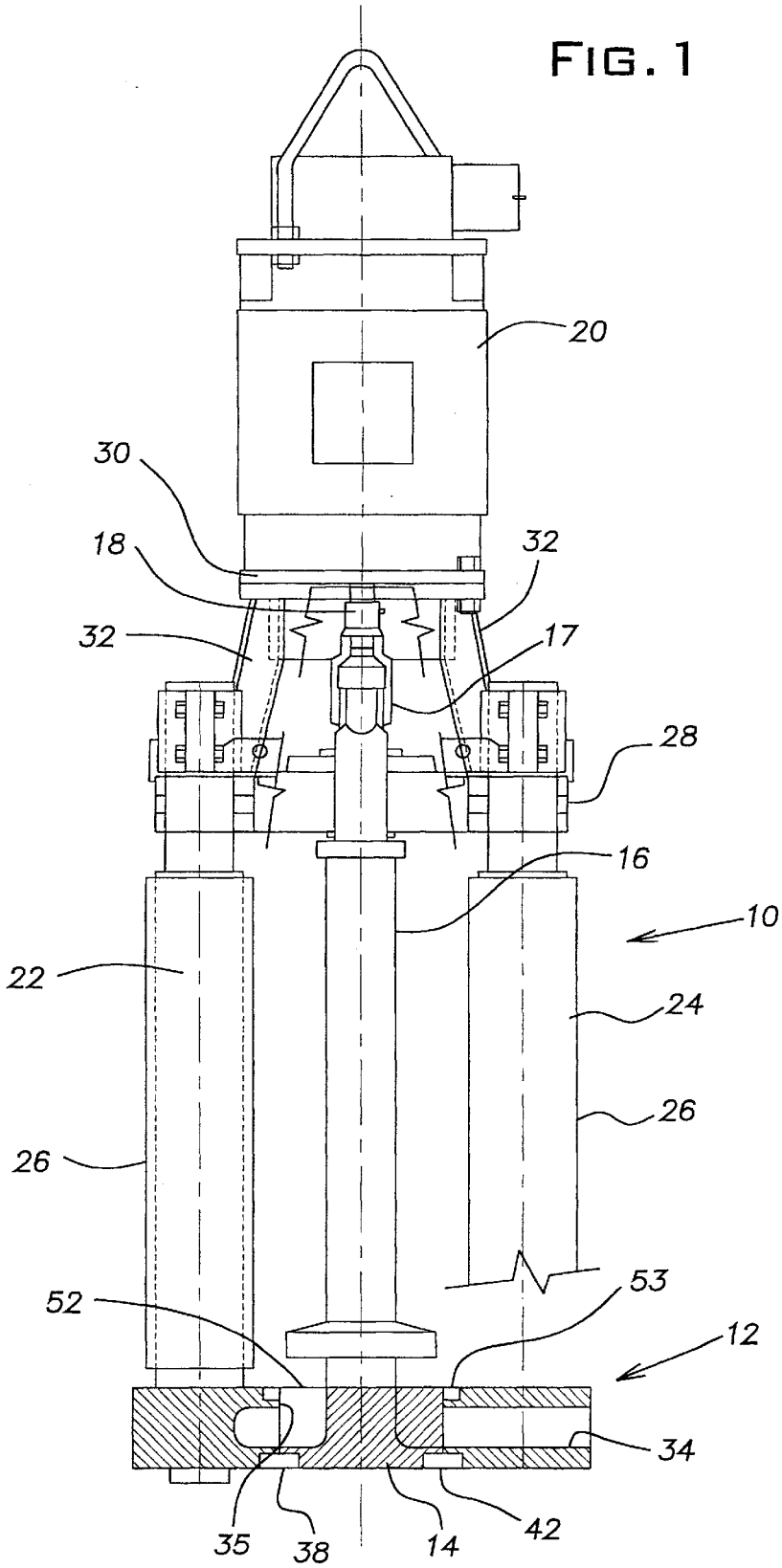
FIG. 1 is a side view, partly in section, of a molten metal pump having an impeller in accordance with the invention.

Referring to FIG. 1, a molten metal pump 10 includes a casing or base member 12 having an impeller 14 mounted therein. The impeller 14 is secured to a shaft 16 and mounted for rotation within the base member 12. The shaft 16 may be formed of a refractory material such as graphite and provided with a protective coating of a refractory material such as silicon carbide or boron nitride. The upper end of the shaft 16 is connected via a coupling 17 with an upper shaft 18 to a motor 20. The motor 20 may be of any desired type and, for example, may be air or electric driven.

The pump 10 includes support posts 22 and 24. The posts are provided with protective sleeves 26 also formed of a refractory material, for example, as is known in the art. The post 22,24 are connected to a support plate 28. In a known manner, the motor 20 is mounted to a motor support platform 30 by means of struts 32. The lower ends of the posts 22 and 24 are attached to the base 12 by means of a refractory cement and/or mechanical fasteners.

The pump 10 is a circulation pump and includes a pump outlet passage 34 from which the metal is discharged for circulation within a vessel (not shown). A riser (not shown) may be connected to the outlet passage 34 to form a transfer pump. Gas may be injected into the passage 34 to provide a gas injection pump.

The pump 10 has a top feed orientation, and molten metal access is provided through an opening 35 in the upper regions of the base 12. For convenience, a generally open configuration is shown, even though preliminary debris screening arrangements may be provided. The impeller 14 may be secured to the shaft 16 by means of a threaded connection, cement and/or mechanical interference members such as pins.

A lower impeller bearing 38 engages a lower base bearings 42. The bearings comprise ring members of silicon carbide adhesively mounted within bearing support grooves by a refractory cement.

Figure 2:
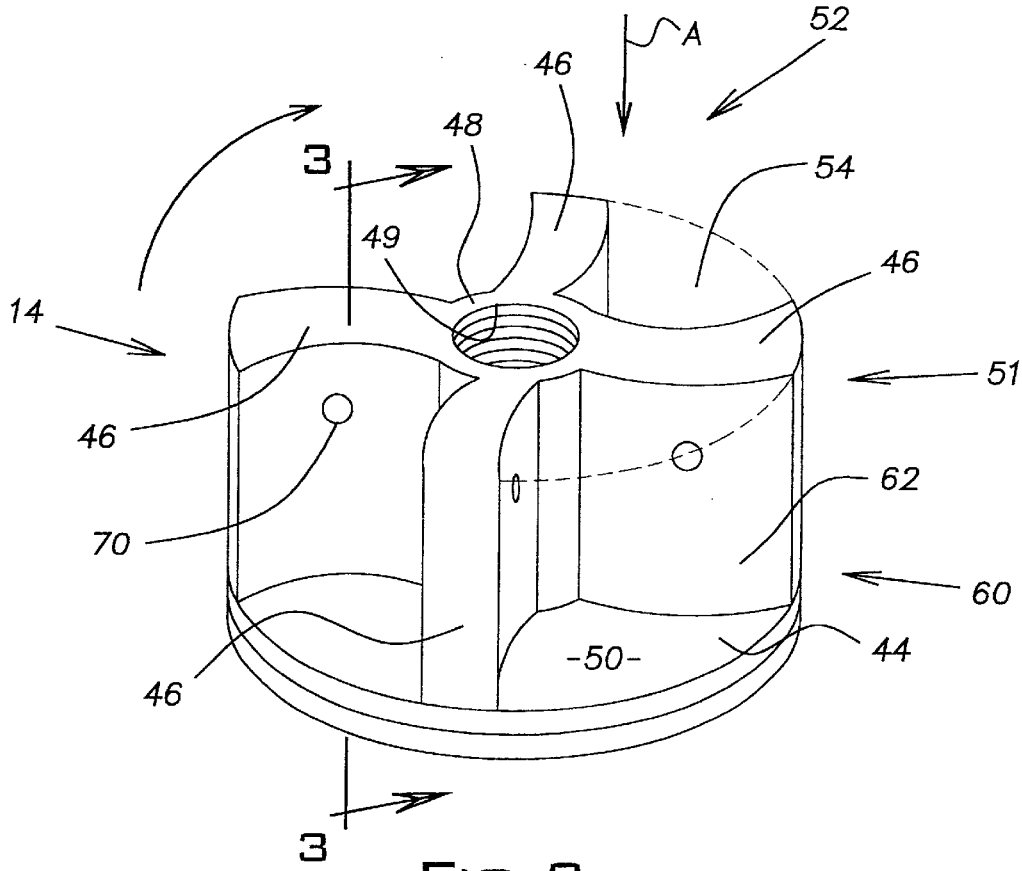
FIG. 2 is a perspective view on an enlarged scale of the impeller from the pump of FIG. 1.
Figure 3:
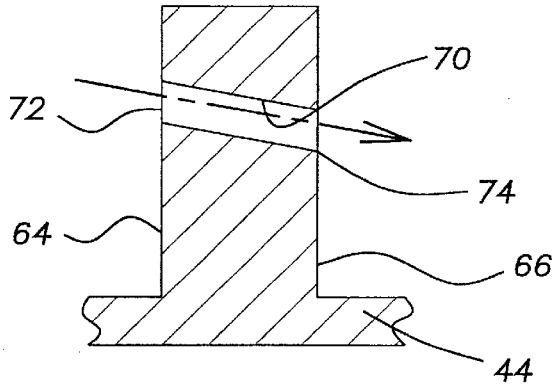
FIG. 3 is a fragmentary sectional view, on an enlarged scale, taken along the line 3—3 in FIG. 2.

Referring to FIGS. 2 and 3, the impeller 14 includes a radially extending member or base 44, angularly spaced vanes 46 and a central hub 48 having a shaft receiving opening 49. The vanes 46 extend radially from the hub 48 and project axially from an upper surface 50 of the base 44 to cooperatively form a vane array 46*a* that has a generally cylindrical outline defined by the extremities of the vanes 46. The upper terminal extremities of the vanes 46 collectively define an impeller upper inlet 52.

As best shown in FIG. 1, a wear ring 53 is positioned around the upper housing opening 35. The ring 53 is formed of a refractory material and provides radial and axial wear surfaces of increased hardness about the opening 35 for receipt of molten metal passing through the opening and into the impeller upper inlet 52.

In the illustrated embodiment, the upper inlet 52 is formed by openings 54 radially extending between adjacent vanes 46. The opening 54 generally extends in a radial plane between adjacent vanes, and the peripheral boundary for one of the openings 54 is shown in phantom outline in FIG. 2. Accordingly, molten metal enters the impeller through upper inlet 52 via downward flow into each of the openings 54 as shown by the arrow A.

The flow of molten metal entering the impeller 14 through the inlet openings 54 is discharged through an impeller outlet 60 collectively provided by the axially extending openings 62 between adjacent vanes 46. The openings 62 extend in segmented cylindrical planes between adjacent vanes 46, and the peripheral boundary of one of the openings 62 is shown in phantom outline in FIG. 2.

Each of the vanes 46 includes a leading surface 64 and a trailing surface 66 with respect to the direction of impeller rotation. The vane has a circumferential thickness between the surfaces 64 and 66 which may be of uniform dimension as shown in FIG. 2 or of increased size adjacent the base 44.

Each of the vanes 46 includes an opening 70 extending through its thickness from an inlet 72 in the surface 64 to an outlet 74 in the surface 66. As shown in elevation in FIG. 3, the vane 46 moves right to left during impeller rotation and the opening 70 is upwardly inclined in the direction of rotation. In this manner, flow of molten metal through the hole 70 is directed downwardly into the lower region of the vane pocket defined between adjacent trailing and leading surfaces of adjacent vanes.

The opening 70 may be inclined at any convenient angle provided an inlet and outlet are respectively formed in the leading and trailing surfaces of the vane. Accordingly, the opening may be inclined upwardly or downwardly relative to the direction of rotation, and it may be parallel or skewed relative to a plane passing through the axis of the impeller.

The opening may be of circular cross-section or non-circular cross-section, e.g., slot-shaped. The diameter of a circular opening may range up to about 2", or more preferably, may be in the range of from about ⅛" to 2".

The opening 70 is located so that the inlet 72 is adjacent the impeller inlet 52 and the hub 48. This tends to promote flow through the opening 70 since a region of low-pressure exists within the impeller at locations adjacent the hub 48. That is, the pressure is sufficiently low to bias intake flow of the molten metal into the impeller. The fluid pressure within the impeller 14 increases in a radially outward direction. At locations radially remote of the hub, a positive pressure is developed so is to tend to favor discharge of molten metal from the impeller. Accordingly, it is preferable that the inlets 72 of the openings 70 are located in close radial proximity with the hub 48 in order to enhance the intake flow of molten metal. The exit can be as shown to use a centrifugal force vector to enhance flow. The size of the openings 70 and their radial positioning may be selected to achieve the desired intake flow.

Figure 4:
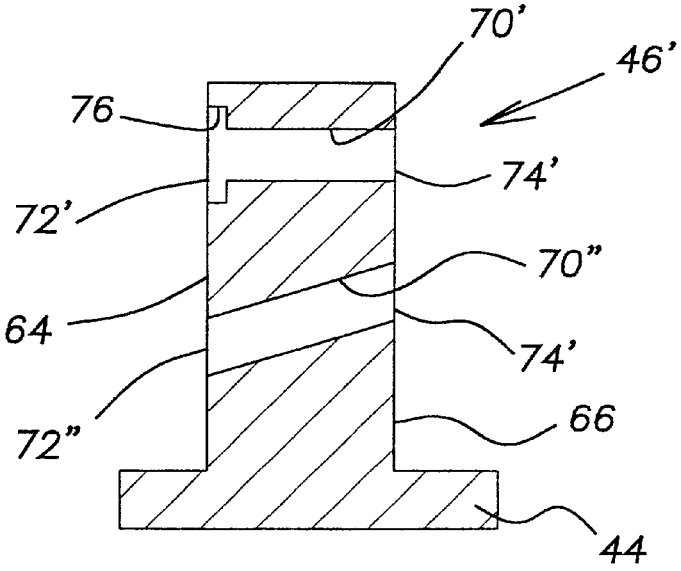
FIG. 4 is a fragmentary sectional view similar to FIG. 3 of a pump vane in accordance with another embodiment of the invention.

Referring to FIG. 4, a modified vane 46' includes a plurality of openings 70' and 70". As shown, a vane may include openings of different configurations and orientations as discussed below.

The opening 70' extends in a direction that is substantially parallel with the plane of the base 44. The opening 70' includes an enlarged portion 76 providing an inlet 72' of increased cross-section as compared with the cross-section of the remaining portion of the opening. The opening 70' terminates at an outlet 74' in the trailing surface 66.

The opening 70" has an inlet 72" in the leading surface 64 and an outlet 74" in the trailing surface 66. As shown, the opening 70" extends in a direction that is inclined downwardly in the direction of rotation. Such a downwardly inclined orientation, may be useful in reducing vibrational tendencies and/or smoothing impeller rotation.

Figure 5:
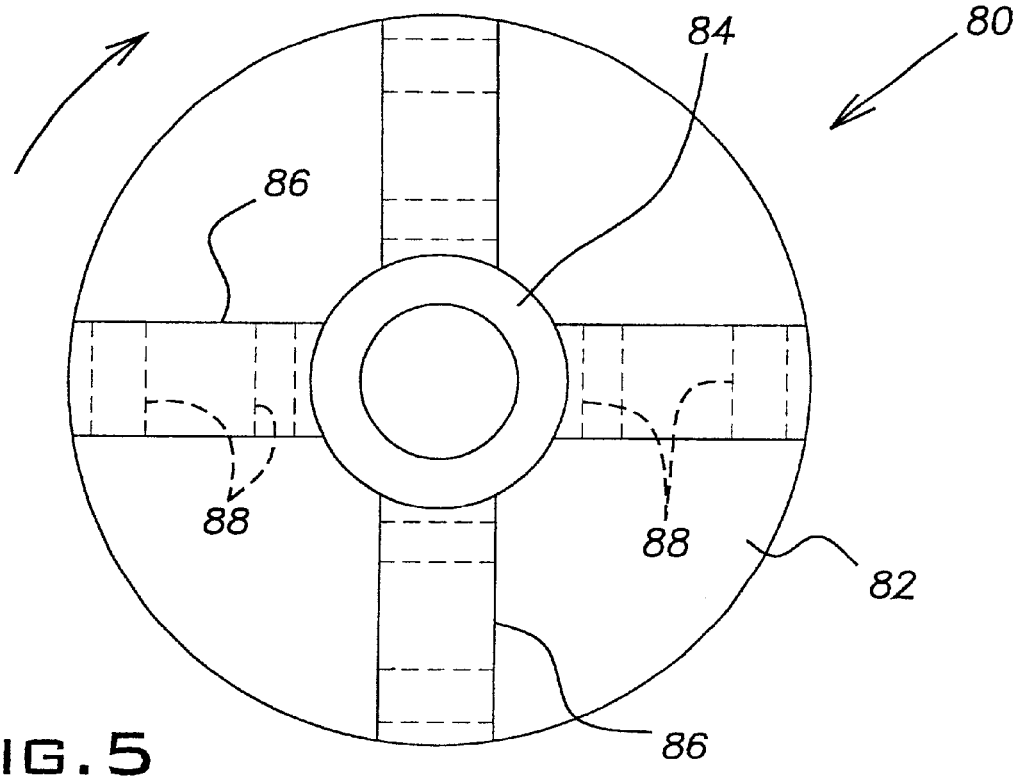
FIG. 5 is a top plan view of an impeller in accordance with yet another embodiment of the invention.

Referring to FIG. 5, an impeller 80 has a radially extending base 82, a central hub 84 and radially extending vanes 86. In this arrangement, the vanes 86 are straight vanes as compared with the curved vanes 46 of the first embodiment.

A pair of openings 88 extend through each of the vanes 86 at radially spaced locations. It is not necessary that each of the vanes 86 has an identical number of openings therethrough. For example, it may be preferable in some arrangements to alternately use single and plural openings through sequential vanes.

Figure 6:
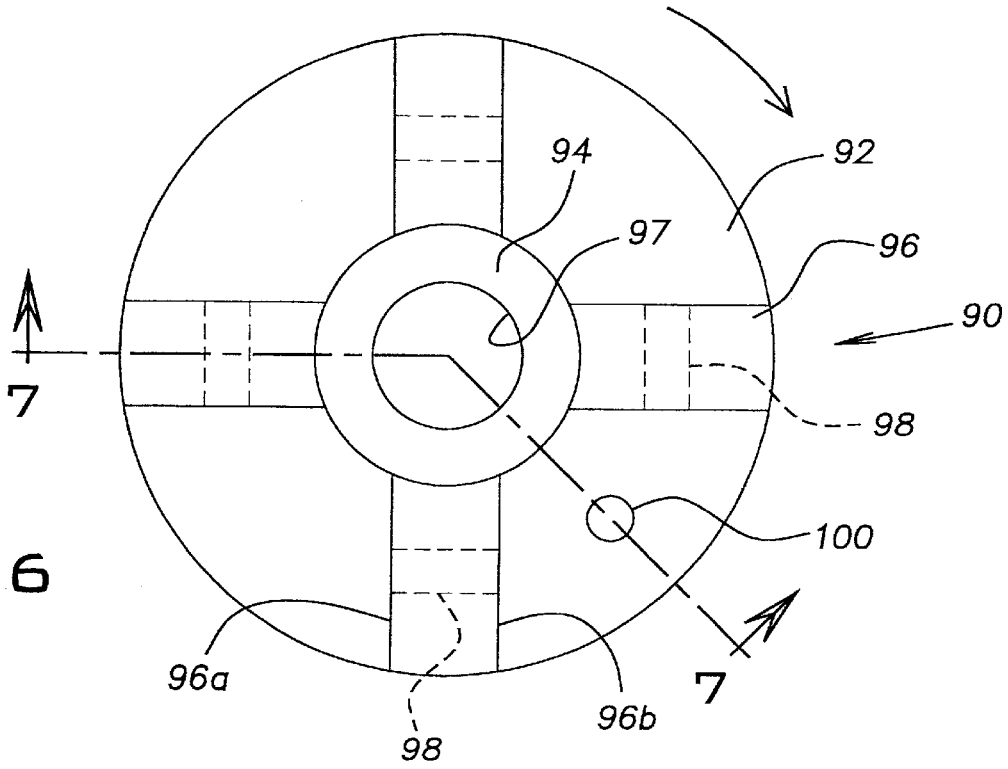
FIG. 6 is a top plan view similar to FIG. 5 of an impeller in accordance with a further embodiment of the invention.
Figure 7:
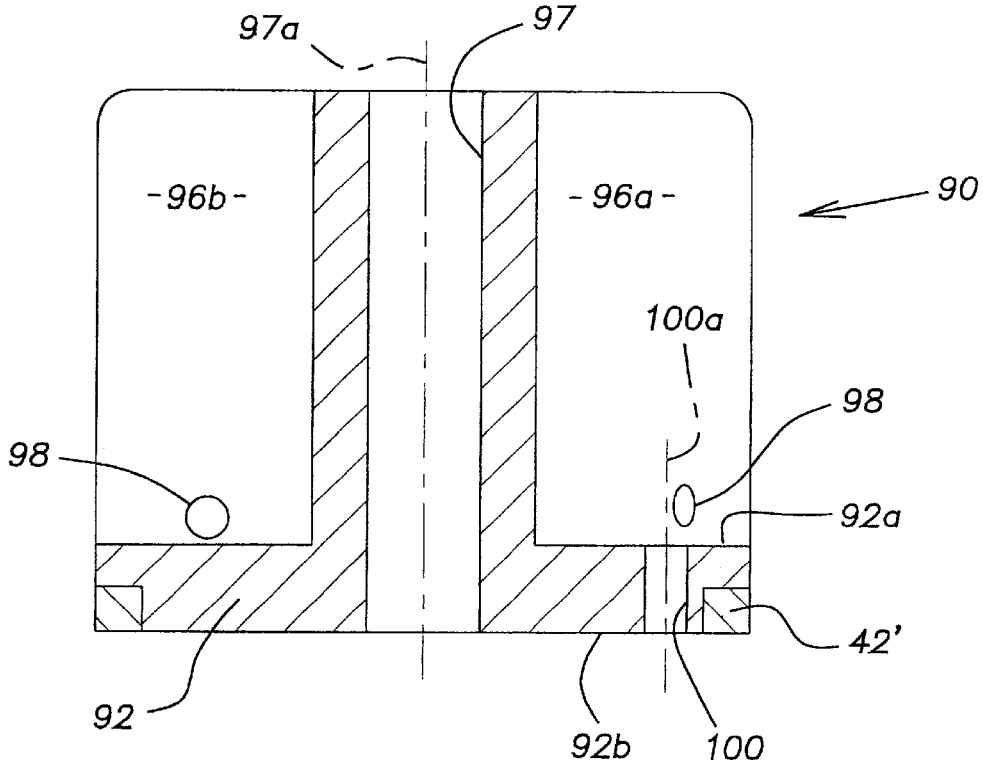
FIG. 7 is an elevational view, partly in section, taken along the line 7—7 FIG. 6.

Referring to FIGS. 6 and 7, an impeller 90 has a radially extending base 92, a central hub 94 and radially extending vanes 96. The hub 94 includes a drive shaft opening 97 and an axis 97*a* about which the impeller rotates. Although the vanes 96 are shown to be straight vanes, curved vanes or other vane configurations may be used.

An opening 98 extends through each of the vanes 96. More particularly, the opening 98 extends from a leading surface 96*a* to a trailing surface 96*b* of each of the vanes. As shown, the openings 98 have a circular configuration, but other shapes may be used.

The openings 98 provide circumferential flow of molten metal between the vane pockets and tend to smooth rotation of the impeller by equalizing the pressure between each pair of vanes within the vane array as described above.

In addition to the openings 98, a single drain hole or opening 100 extends through the base 92 for purposes of enhancing the drainage of molten metal from the vane pockets upon removal of the pump from below the surface of the molten metal. The opening 100 has a circular cross-section, but it may have any convenient cross-sectional shape.

The opening 100 also has a longitudinal axis 100*a*. Preferably, the opening 100 is parallel with the axis of the impeller 90, or more particularly, the axis 100*a* of the opening 100 is parallel with the axis 97*a* of the opening 97.

The impeller 90 includes four vane pockets, each being defined by the adjacent trailing and leading vane surfaces together with the intermediate hub and base surface portions. As the pump is removed from the molten metal, molten metal will drain through the opening 100 to substantially empty the associated vane pocket and cause molten metal in other vane pockets to flow through the openings 98 into the drained vane pocket associated with the opening 100. In some instances, the pump may be tipped from a vertical orientation during its removal to naturally drain the vane pocket or pockets in the lower-most orientations. Such tipping of the pump will also result in the flow of molten metal trapped within the upper-most vane pockets through the openings 98 to the lower-most vane pocket or pockets and more complete drainage.

The selected axial positioning of the openings 98 also tends to enhance drainage. Preferably, the openings 98 are located just above the upper extremities of the base 92. As shown in FIG. 7, the openings 98 are positioned immediately above an upper annular shaped surface 92*a* of the base 92 to more fully drain the vane pocket.

In addition to its drainage functions, the drain opening 100 also tends to reduce thermal, shock when the impeller is introduced into the molten metal. For example, following repair or other servicing of the pump, the temperature of the impeller will be relatively cool as it is submerged in the molten metal. The rapid heating of lower surface 92*b* of the base 92 may thermally shock and fracture the refractory cement with which the lower base bearing 42' is mounted. It is believed that the tendency of such thermal shock and/or fracture to occur is suppressed by the prompt flow of molten metal through the opening 100 and into contact with the upper surface 92*a* of the base 92. Consequently, the opening 100 has a function independent of drainage, and it may be the only aperture in the base or vane arrangement of the impeller.

The opening 100 may be selectively placed to further enhance the balance and vibration-free rotation of the impeller. Typically, the construction of the impeller 90 may include an angular location of excess momentum or weight as determined by the stopped orientation of the impeller following free rotation about a horizontal axis. The opening 100 may be positioned at such location.

Figure 8:
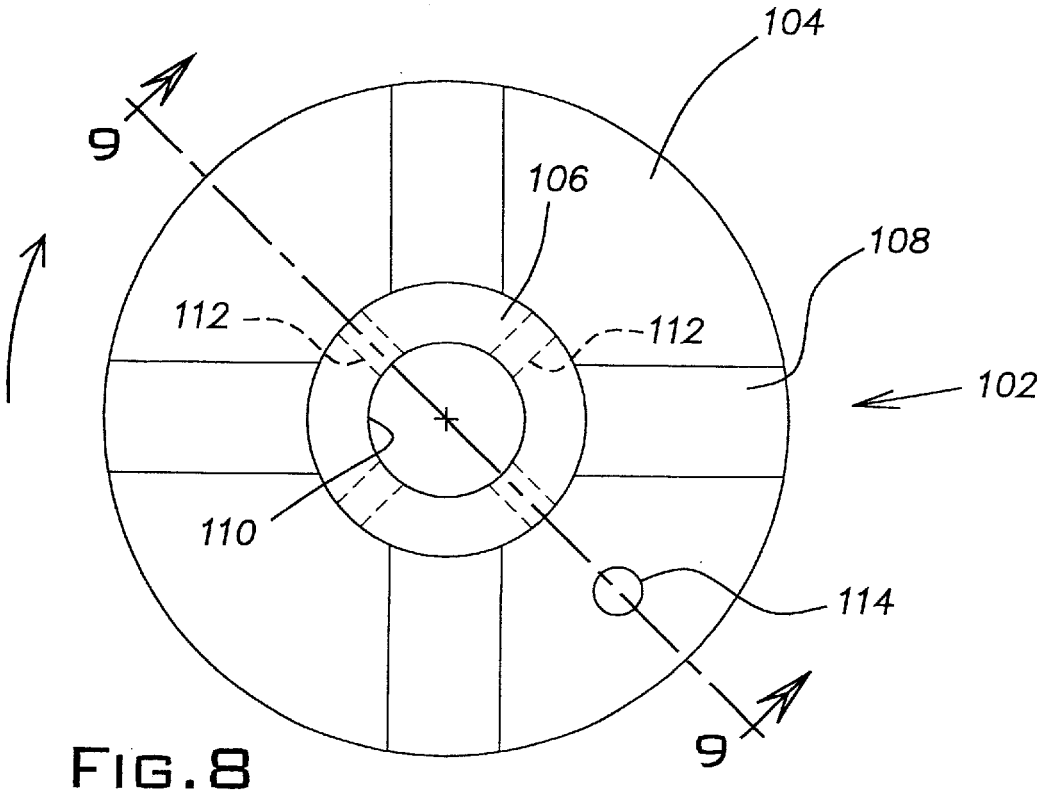
FIG. 8 is a top plan view similar to FIG. 6 of an impeller in accordance with yet a further embodiment of the invention.
Figure 9:
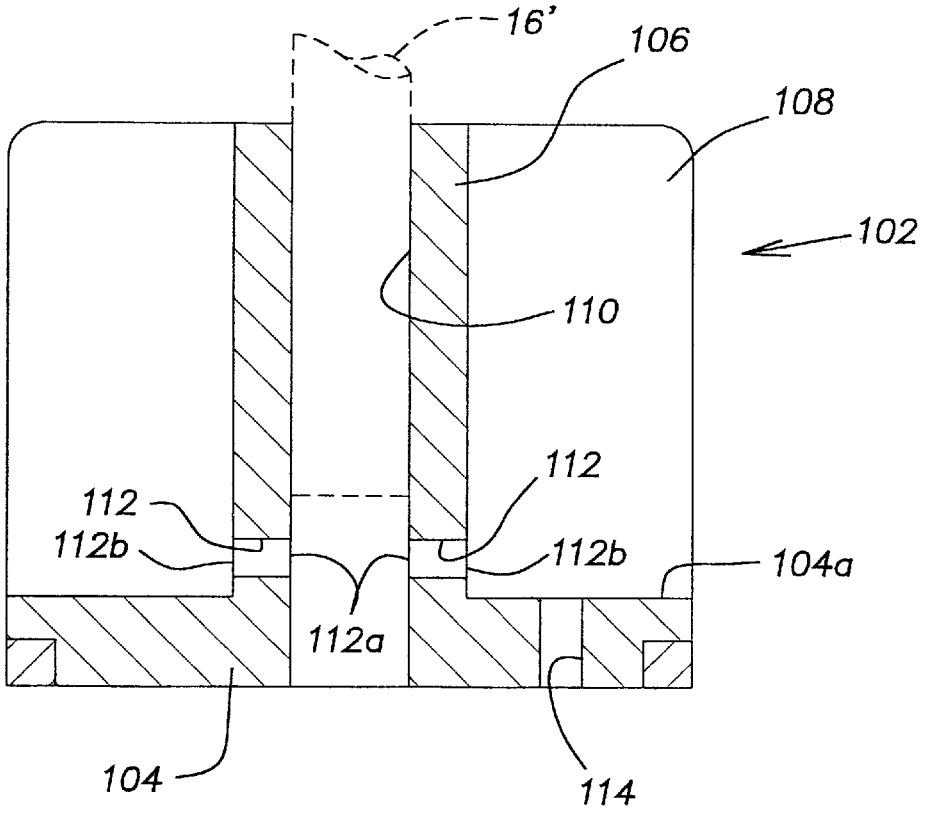
FIG. 9 is an elevational view, partly in section, taken along the line 9—9 in FIG. 8.

Referring to FIGS. 8 and 9, an impeller 102 has a radially extending base 104, a central hub 106 and radially extending vanes 108. A drive shaft opening 110 extends axially through the hub 106. Drain openings 112 extend radially through the hub 106 and a drain opening 114 extends axially through the base 104.

As best shown in FIG. 8, a drain opening 112 is associated with each of the vane pockets formed by the adjacent vane pairs and associated impeller surfaces. Each drain opening 112 extends between an outlet 112*a* in the shaft opening 110 and an inlet 112*b* in its associated vane pocket. It should be appreciated that during impeller rotation, molten metal flow will occur in a radially outward direction through the openings 110 and the outlet and inlet roles will be reversed.

Referring to FIG. 9, a portion of a drive shaft 16' is shown in dotted outline. The drive shaft 16' terminates at a location above the openings 112, or more particularly, the outlets 112*a*. The openings 112 extend radially through the annular wall of the hub 106 at locations just above the base 104, and more particularly, an upper base surface 104*a*.

The drain opening 114 provides accelerated drainage of its associated vane pocket and also suppression of thermal shock as described above with respect to the drain opening 100.

Figure 10:
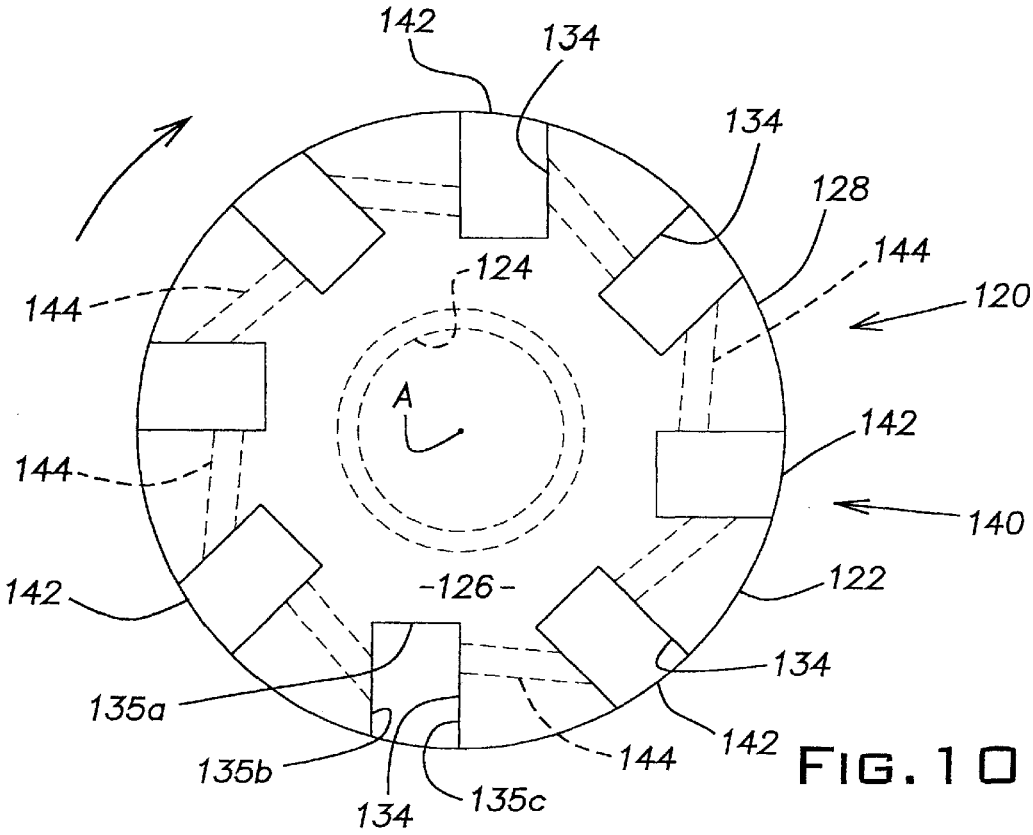
FIG. 10 is a top plan view similar to FIG. 8 of an impeller having pumping chambers in accordance with another embodiment of the invention.
Figure 11:
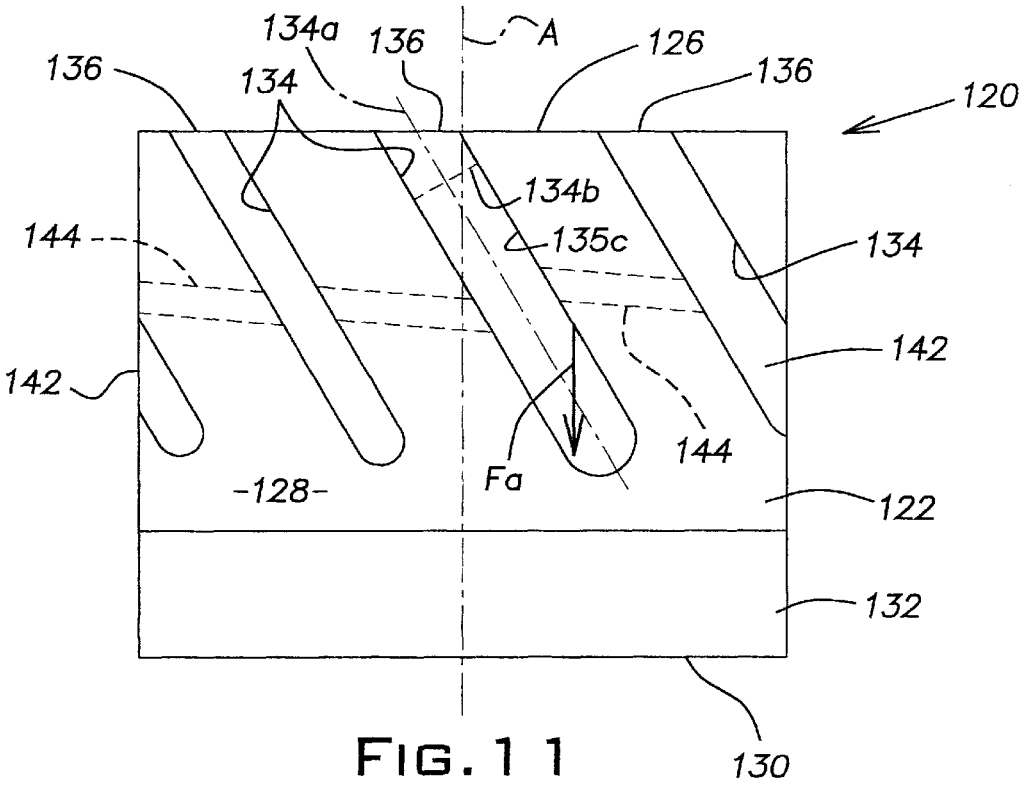
FIG. 11 is a side elevational view of the impeller of FIG. 10.

Referring to FIGS. 10 and 11, an impeller 120 in accordance with a further embodiment of the invention is shown. The impeller 120 has a monolithic construction of a refractory material such as graphite. The impeller 120 has a generally cylindrical body 122 including a central shaft opening 124 which may be provided with internal threads for engaging a shaft (not shown). The body 122 has an upper radial surface 126, a cylindrical side surface 128 and a lower radial surface 130. A lower impeller bearing 132, similar to the bearing 42 in the first embodiment, is located adjacent the bottom periphery of the impeller 120 for engagement with a base or housing bearing.

The impeller also includes a plurality of the elongate peripheral pumping chambers 134 that each intersect the radial surface 126 or extremity of the impeller to form chamber openings 136. The chambers 134 extend to an axial terminal end above the base region of the impeller and spaced from the bearing 132.

For convenience, the impeller is shown in a top feed orientation, and includes an upper impeller inlet 138 collectively formed by radially extending openings 136. An impeller outlet 140 is provided by openings 142 formed in the radial extremities of the impeller along the length of each of the pumping chambers 134.

As shown, the chamber 134 has a rectangular cross-section that is formed by radially cutting the body 122 as with a radially oriented drill bit moved in an axial or longitudinal direction along the body surface 128. Each of the chambers 134 has a chamber length extending along a longitudinal chamber axis 134*a* and a transverse axis 134*b* extending in a plane that is perpendicular to the longitudinal axis. The cross-sectional shape of the pumping chamber 134 is generally rectangular, but it may be circular, polygonal or irregular.

As shown, the chamber length as measured along its longitudinal axis is substantially greater than the major cross dimension or widths measured along its transverse axis 134*b*. The ratio of chamber length to width may be 3:1 to 20:1, and more preferably, 3:1 to 5:1. Illustrative sizes of pump chamber lengths range from 2" to 6" or greater and pumping chamber widths range from 0.25" to 1.5" or greater.

As best shown in FIG. 10, the pumping chambers 134 comprise elongate bores or holes in the body 122 that have longitudinal surfaces including a radially inner surface 135*a* extending to a leading surface 134*b*, and a trailing surface 135*c* which respectively extend to the openings 142. The surfaces 135*a*, 135*b* and 135*c* may be planar as shown or arcuate as well as combinations thereof.

The pumping chambers 134 are preferably angularly spaced about the periphery of the impeller 120 in a uniform pattern. An even or odd number of pumping chambers may be used. An odd number of chambers may tend to reduce vibration during pumping operation.

The peripheral location of the pumping chambers is preferred since the highest impeller surface speeds and centrifugal force are encountered at the periphery. This tends to eject any particulate contaminants and reduce the tendency for blockage to occur. As best shown in FIG. 10, the pumping chambers 134 are located in the radially outermost ⅓ of the body 122. In contrast, most vane or blade impellers have vane pockets extending over 40% of the radial extent of the impeller body.

The pumping chambers 134 extend along the surface 128 an axial distance corresponding with about 80% of the longitudinal extent of the body 122. Generally, the pumping chambers should extend along at least 10% and may extend along all of the longitudinal extent of the body.

The total number of chambers and the dimensions of the chambers may be varied in accordance with the desired pumping flows. Preferably, the pumping chambers are inclined into the direction of rotation which is clockwise as shown in FIGS. 10 and 11. As measured from the vertical or with respect to the longitudinal axis A of the impeller 120, the angle of inclination may range up to 45 degrees. Herein, the pumping chamber surfaces are similarly inclined, and the trailing surface 135*c* provides an axial pumping force represented by the force vector Fa in FIG. 11. This axial pumping force enhances fluid flow into and through the chamber 134, and cooperates with the centrifugal force to rapidly intake and discharge fluid. In this manner, both axial and radial pumping are imposed on the fluid within the chamber 134. In comparison, known commercially available molten metal pumps rely solely on gravity to provide an axial feed into the pump.

In illustration of multiflow pumping in accordance with the invention, the maximum pumping pressures of the following impellers were compared using the same pump drive arrangement and pump housing in a water system. The impellers were similarly sized and sequentially fitted to the pump shaft for operation at a constant speed to determine the maximum pumping pressure. The maximum pumping pressure was determined by measuring the maximum pressure developed in a 1½ in. ID closed conduit connected to the pump outlet.

Impellers

1. Impeller 120 with a 30 degree pump chamber inclination and eight pumping chambers.
2. An impeller similar to impeller No. 1, but having a pumping chamber length to width ratio less than 3:1.
3. A standard six hole squirrel cage impeller.
4. An impeller having three curved vanes.
5. An impeller having four flat vanes similar to FIG. 4 in U.S. Pat. No. 5,586,863.
6. An impeller having four flat vanes similar to FIG. 3A in U.S. Pat. No. 5,586,863.
7. An impeller having three straight vanes.
8. A trilobular impeller similar to FIG. 5 in U.S. Pat. No. 5,203,681.
9. An impeller similar to impeller No. 8, but inverted to give bottom feed.
10. An impeller having four curves vanes.
11. An impeller similar to impeller No. 1, but having a cone-shaped upper body.

Figure 11A:
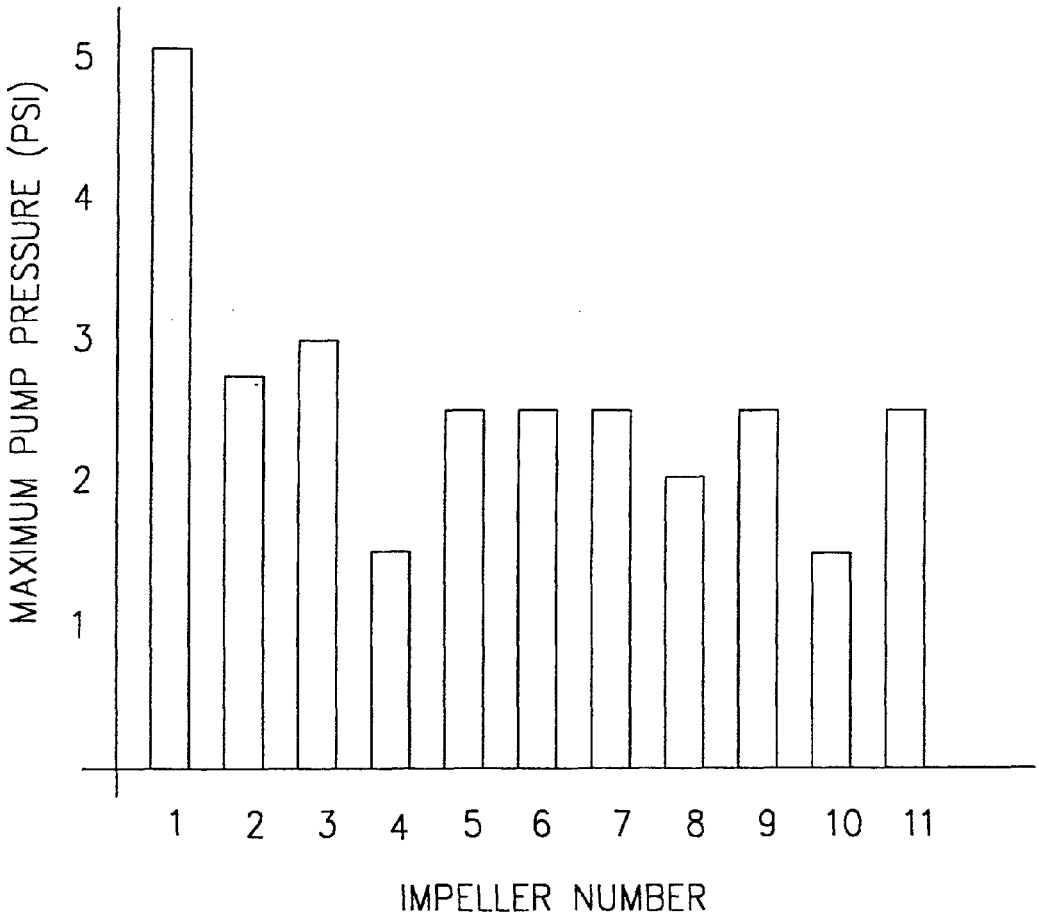
FIG. 11A is a graph showing the relative maximum pumping pressure for various impellers.

Referring to FIG. 11A, the maximum pumping pressures for impellers Nos. 1 through 11 are shown. Impeller No. 1, in accordance with the invention, developed a maximum pressure of 5 psi so as to exceed the next highest pressure, impeller No. 3 at 3 psi, by about 67 percent. Impeller No. 1 also exceeded impeller No. 2 which had a similar construction, but a pumping chamber length to width ratio of less then 3:1.

Generally, the multiflow impeller of the invention provided about twice the maximum output pressure of prior art vane, blade and trilobular impeller designs represented by impellers Nos. 3 through 10. The increased maximum pressure provided by the multiflow impeller is proportional to volume flow and increased pumping efficiency. High pumping pressures are particularly useful in pumping relatively dense metals for both circulation and lifting. For example, high pressure is particularly advantageous in a zinc system to provide lift heights since the density of zinc is about 449 lbs./ft$^3$ compared with 170 lbs./ft$^3$ for aluminum and 62 lbs./ft$^3$ for water.

As shown in FIGS. 10 and 11, the pumping chambers 134 may be connected by openings 144 extending therebetween. The openings 144 provide circumferential flow and the advantages as described above.

Figure 12:
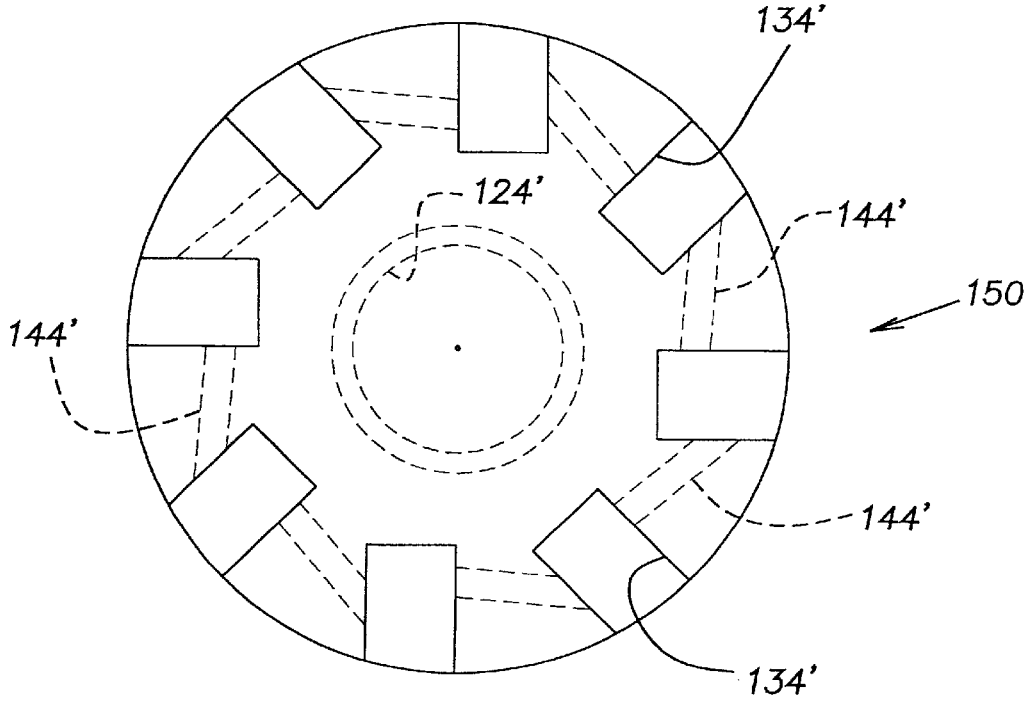
FIG. 12 is a top plan view similar to FIG. 10 of an impeller in accordance with yet another embodiment of the invention.
Figure 13:
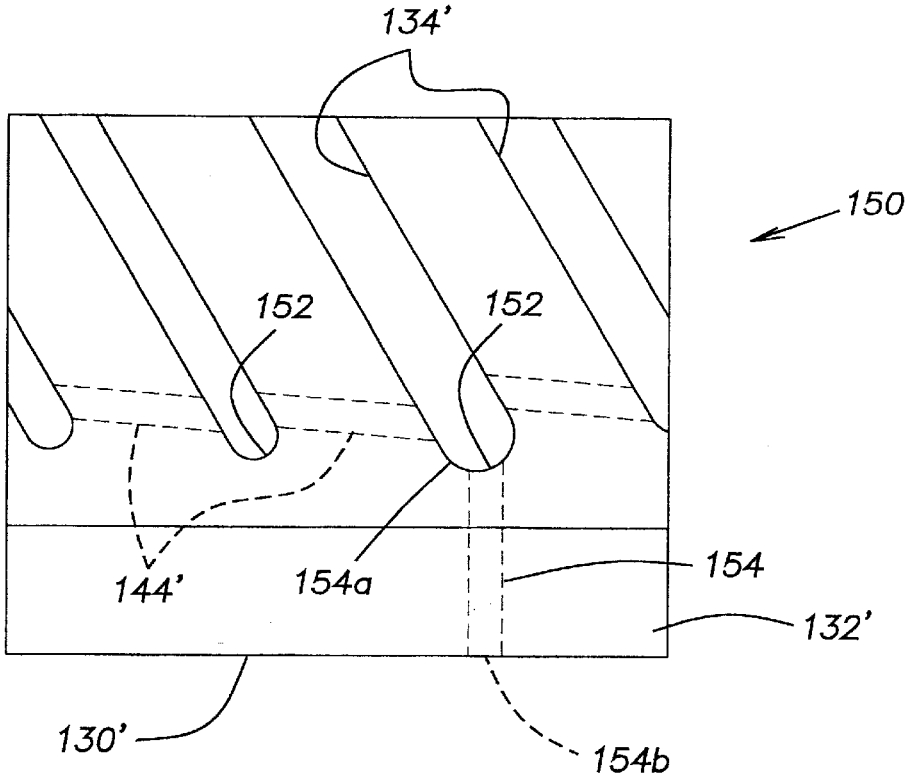
FIG. 13 is a side elevational view of the impeller of FIG. 12.

Referring to FIGS. 12 and 13, an impeller 150 is shown. The impeller 150 is substantially identical with the impeller 120, and for convenience, corresponding elements are similarly numbered with the addition of a prime designation.

The pumping chambers 134' of the impeller 150 are connected by openings 144' and provide advantages corresponding with those discussed above. The openings 144' are axially located adjacent the lower extremities or bottoms 152 of the chambers 134' to also enhance drainage. To that end, a drain opening 154 has an inlet 154*a* in the bottom 152 of the chamber 134' and an outlet 154*b* in the lower radial surface 130' of the impeller 150.

The openings 144' provide circumferential flows and the advantages discussed above. Similarly, the openings 144' cooperate with the drain opening 154 to provide similar drainage advantages. The opening 154 also tends to suppress thermal shock.

Figure 14:
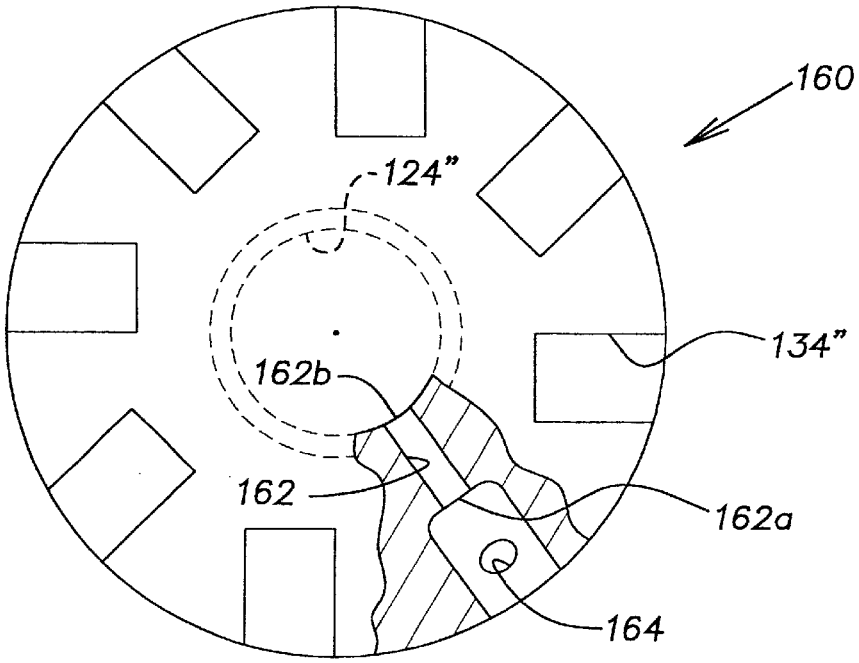
FIG. 14 is a top plan view, partly in section, of an impeller in accordance with another embodiment of the invention.
Figure 15:
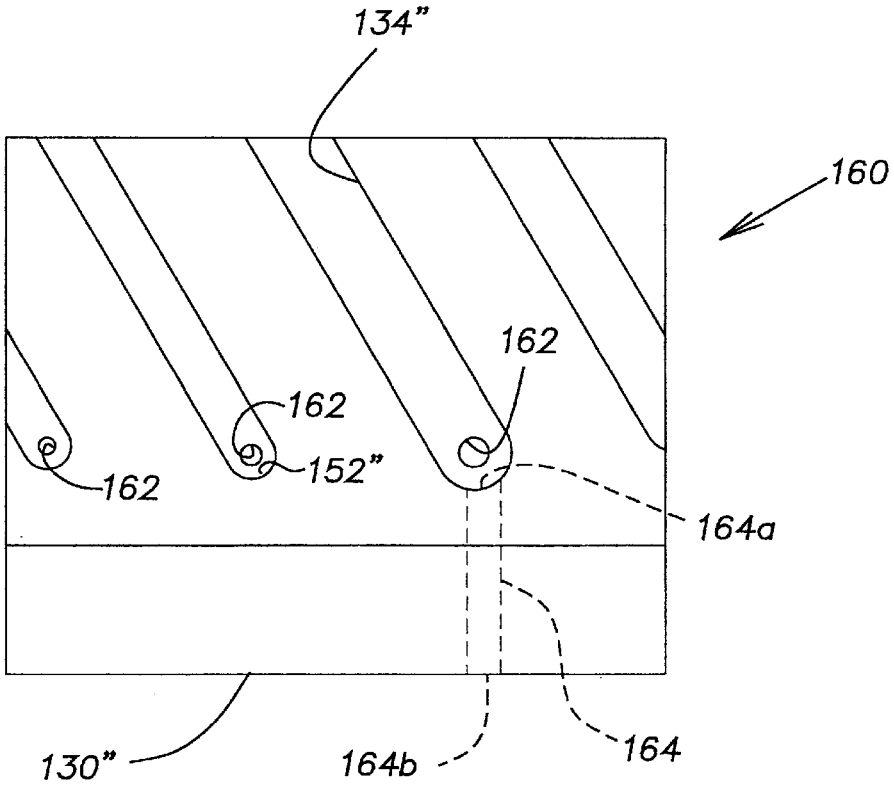
FIG. 15 is a side elevational view of the impeller of FIG. 14.

Referring to FIGS. 14 and 15, an impeller 160 is shown. The impeller 160 is substantially identical with the impellers 120 and 150, and for convenience, corresponding elements are similarly numbered with the addition of a double prime designation.

The pumping chambers 134" each include a radial drain opening 162. The openings 162 are located adjacent the lower extremities or bottoms 152" of the pumping chambers 134". Accordingly, the opening 162 includes an inlet 162*a* in or adjacent to the bottom 152" and an outlet 162*b* in the shaft opening 124". The openings 162 extend above the base region of the impeller 160 and the outlets 162*b* are located in the shaft opening 124" remote of a received shaft. In the impeller 160, individual drainage of each of the pumping chambers 134" is provided through its associated opening 162.

The drain opening 164 extends axially to the lower radial surface 130". Thus, the opening 164 has an inlet 164*a* in the bottom 152" and an outlet 164*b* in the lower radial surface 130". The opening 164 is believed to achieve the same drainage and thermal shock advantages as described above with respect to the opening 154.

Figure 16:
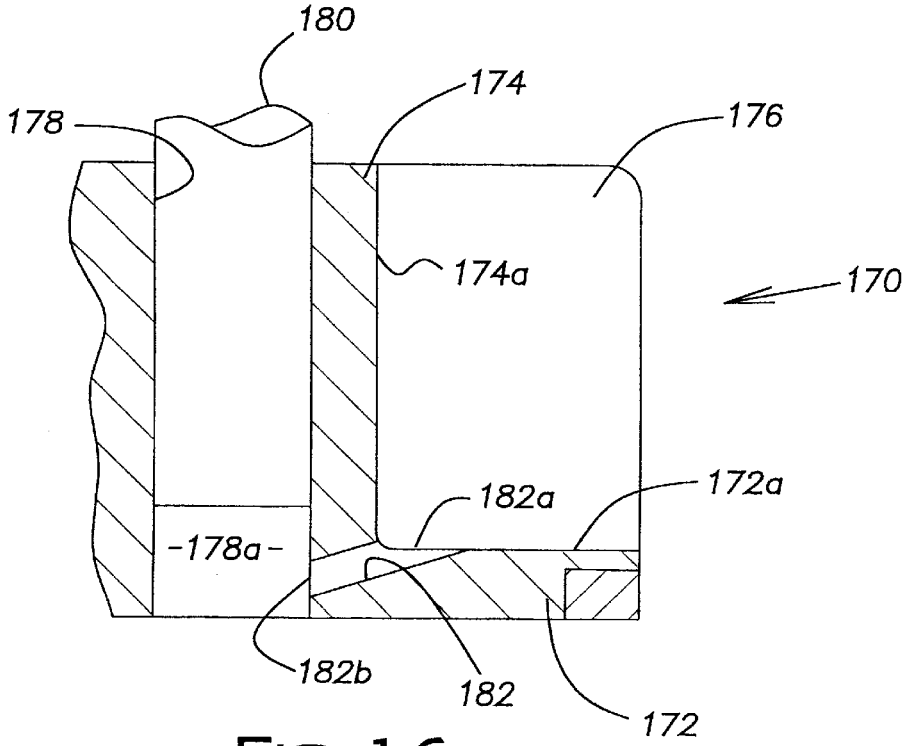
FIG. 16 is a fragmentary sectional view similar to FIG. 7 showing a further embodiment of the invention.

Referring to FIG. 16, an impeller 170 is shown. The impeller 170 is similar to the impeller 14 and includes a radially extending member or base 172, a central hub 174 and radially extending vanes 176. The hub 174 includes a drive shaft opening 178 and a drive shaft 180 engaged therein is shown.

The impeller 170 includes one or more openings or drain holes 182 extending from an inlet 182*a* in an upper surface 172*a* of the base 172 to an outlet 182*b* in a cylindrical wall 178*a* forming the drive shaft opening 178. The opening 182 has a cylindrical configuration and circular cross-section, but any convenient shape may be used. The openings 182 provide the same advantages as discussed above with respect to the opening 100. It should be appreciated that the inlet opening 182*a* may extend across the intersection between the hub 174 and base 172. In this case, the opening 182*a* extends in both a cylindrical surface 174*a* of the hub 174 and the upper surface 172*a* of the base 172.

During operation, the opening 182 also pumps fluid radially outward therethrough to provide increased flow. This additional pumping provides a jet flow of fluid to dislodge accumulated debris. The opening 112 in FIG. 9 provides a similar function.

Figure 17:
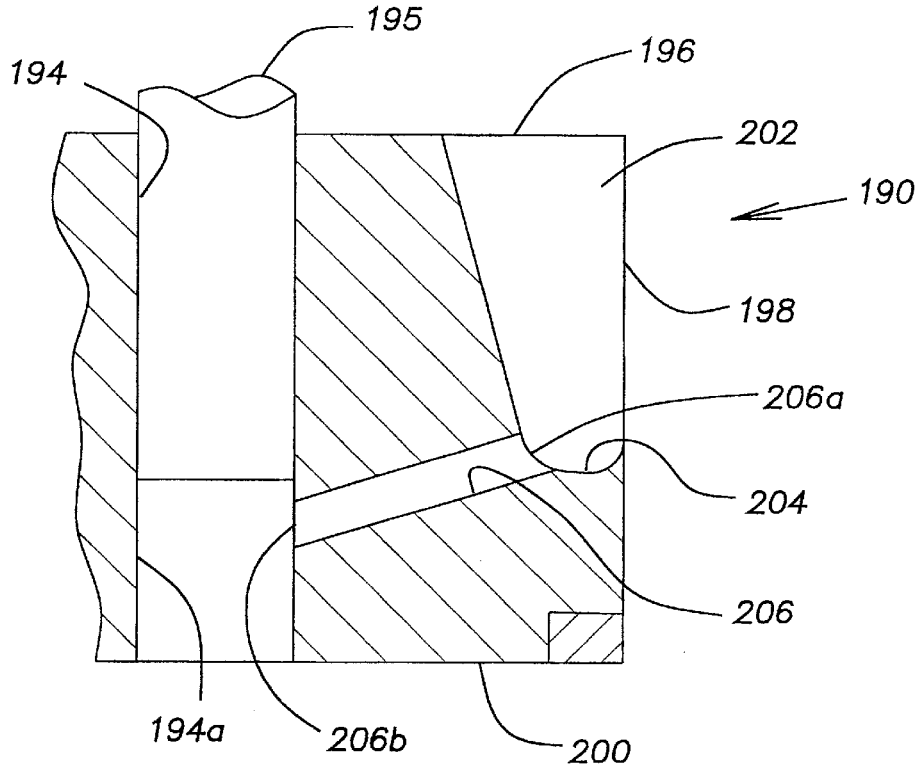
FIG. 17 is a fragmentary sectional view similar to FIG. 16 showing another embodiment of the invention.

Referring to FIG. 17, an impeller 190 in shown. The impeller 190 is similar to the impeller 120 and has a generally cylindrical body 192 including a central shaft opening 194. A drive shaft 195 is shown engaged within the drive shaft opening 194. The body 192 has an upper radial surface 196, a cylindrical side surface 198 and a lower radial surface 200. The impeller 190 also includes a plurality of peripheral pumping chambers 202.

The pumping chamber 202 has a bottom 204. A drain opening 206 has an inlet 206*a* in the bottom 204 of the pumping chamber and an outlet 206*b* in the shaft opening 194, or more particularly, a cylindrical wall 194*a* thereof. The opening 206 tends to provide the drain and thermal shock suppression advantages as discussed above with respect to the opening 154. During operation, the opening 206 provides a jet flow of fluid to dislodge debris in a manner similar to that described above with respect to opening 112 in FIG. 9 and opening 182 in FIG. 16.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. An impeller for pumping molten metal including a shaft assembly having an axis, a central hub fixed to said shaft, said hub including a shaft opening for receiving said shaft, and a radial base extending from said hub transversely away from said shaft, vanes projecting in an axial direction from said base at angularly spaced locations about said shaft on a first side of said base, and an opening in said base remote of said axis communicating between said first side and said shaft opening, said opening being inclined in the direction of rotation for discharge of molten metal.

2. An impeller as set forth in claim 1, wherein adjacent vanes cooperate with intermediate base and hub portions to form a vane pocket, and said opening extends through said hub communicating between said shaft opening and vane pocket.

3. An impeller as set forth in claim 2, including a plurality of said openings, one of said openings communicating between each of said vane pockets and said shaft opening.

4. An impeller for pumping molten metal including a body having a longitudinal axis, an end surface transversely intersecting said axis, a peripheral surface extending about said axis, and a plurality of elongate pumping chambers extending in said body at angularly spaced locations about said longitudinal axis, each of said pumping chambers having a length extending along said peripheral surface and a width extending transverse to said length, said pumping chamber having an inlet opening formed in said end surface and an outlet opening formed in said peripheral surface, said pumping chamber length and width being in a ratio of from about 3:1 to about 20:1.

5. An impeller as a claim 4, wherein said impeller has a direction of rotation in which it is adapted to be driven and said pumping chamber includes a chamber surface that extends at an angle inclined into said direction of rotation whereby said chamber surface provides axial pumping upon rotation of said impeller.

6. An impeller as in claim 4, wherein said outlet opening extends along substantially the entire length of said pumping chamber.

7. An impeller as in claim 6, wherein said ratio is from about 3:1 to about 5:1.

8. An impeller as in claim 6, wherein said body has a longitudinal dimension and said pumping chamber length extends along 10 to 100% of said longitudinal dimension of said body.

9. An impeller as in claim 8, wherein said pumping chamber length extends along 20 to 85% of said longitudinal dimension of said body.

10. An impeller as in claim 6, wherein at least one communicating bore extends through said body connecting said pumping chambers.

11. An impeller as in claim 6, wherein a plurality of communicating bores extend through said body connecting said pumping chambers.

12. An impeller as in claim 6, wherein at least one bore extends from said pumping chamber through said body to a surface of said body remote of said end surface and said peripheral surface.

13. An impeller as in claim 12, wherein said body includes a second end surface axially spaced from said first mentioned end surface and a shaft opening including a shaft receiving surface, and said remote surface is one of said second end surface and said shaft receiving surface.

14. An impeller as in claim 6, wherein said body has a cylindrical shape including a first radial end forming said end surface, a second radial end forming an opposed second end surface and a cylindrical surface extending between said first and second radial ends forming said peripheral surface.

15. An impeller as in claim 14, wherein said body includes a central shaft mounting bore having a bore surface and is a monolithic construction of a refractory material.

16. An impeller as in claim 14, wherein a plurality of communicating bores extend through said body connecting said pumping chambers.

17. An impeller as in claim 6, wherein at least one bore extends from at least one of said pumping chambers through said body to a surface of said body remote of said end surface and said peripheral surface.

18. An impeller as in claim 6, wherein said pumping chamber length extends along said peripheral surface at an angle with respect to said longitudinal axis.

19. An impeller as in claim 18, wherein said impeller has a direction of rotation in which it is adapted to be rotatably driven and said angle is inclined into said direction of rotation.

20. An impeller as in claim 18, wherein said angle is between 0 and 45 degrees.

21. An impeller as in claim 6, wherein said pumping chamber length extends in a linear direction.

22. An impeller as in claim 6, wherein said pumping chamber has a rectangular cross-section.

23. An impeller as in claim 4, wherein said body has a radial dimension and said pumping chamber is located substantially entirely in the radially outermost ⅓ of said radial dimension of said body.

24. An impeller for pumping molten metal including a body having a longitudinal axis about which it is adapted to be driven in a direction of rotation, an end surface transversely intersecting said axis, a peripheral surface extending about said axis, and a plurality of elongate pumping chambers extending in said body at angularly spaced locations about said longitudinal axis, each of said pumping chambers having a length extending along said peripheral surface and a width extending transverse to said length, said pumping chamber including a chamber surface that extends at an angle inclined into said direction of rotation whereby said chamber surface provides axial pumping upon rotation of said impeller, wherein said pumping chambers are located in the radially outermost one third of said body.

25. A molten metal pump comprising an elongated shaft having a first end connected to a driving means and a second end connected to an impeller, said impeller being disposed in a pump housing having a housing inlet, through which molten metal may be drawn and a housing outlet through which molten metal may be discharged, said impeller including a body having a longitudinal axis, an end surface transversely intersecting said axis, a peripheral surface extending about said axis, and a plurality of elongate pumping chambers extending in said body at angularly spaced locations about said longitudinal axis, each of said pumping chambers having a length extending along said peripheral surface and a width extending transverse to said length, said pumping chamber having an inlet opening formed in said end surface and an outlet opening formed in said peripheral surface, said pumping chamber length and width being in a ratio of from about 3:1 to about 20:1.

* * * * *

UNITED STATES PATENT AND TRADEMARK OFFICE

CERTIFICATE OF CORRECTION

PATENT NO. : 6,755,614 B1
DATED : June 29, 2004
INVENTOR(S) : Dale T. Leham

It is certified that error appears in the above-identified patent and that said Letters Patent is hereby corrected as shown below:

Title page,
Item [56], References Cited, U.S. PATENT DOCUMENTS, include:

| | | |
|---|---|---|
| -- 3,984,234 | 10/1976 | Claxton et al. |
| 5,944,496 | 8/1999 | Cooper |
| 6,303,074 | 10/2001 | Cooper -- |

Signed and Sealed this

Seventeenth Day of August, 2004

JON W. DUDAS
*Acting Director of the United States Patent and Trademark Office*